United States Patent [19]

Kim et al.

[11] Patent Number: 4,892,309

[45] Date of Patent: Jan. 9, 1990

[54] TWO AND FOUR POSITION TARGET ASSEMBLY

[75] Inventors: Mark S. Kim, Chicago; Gary L. Berge, Crystal Lake, both of Ill.

[73] Assignee: Williams Electronics Games, Inc., Chicago, Ill.

[21] Appl. No.: 284,255

[22] Filed: Dec. 14, 1988

Related U.S. Application Data

[62] Division of Ser. No. 18,480, Feb. 25, 1987, Pat. No. 4,822,046.

[51] Int. Cl.[4] ..... A63F 7/00

[52] U.S. Cl. ..... 273/127 R; 273/129 S

[58] Field of Search ..... 273/127 R, 121 A, 129 W, 273/127 D, 118 D, 123 A, 121 R, 110, 113, 115, 116, 125 R, 181 J, 119 A, 183 R, 125 A, 122 A, 123 A, 124 A:129 V; 200/61.11

[56] References Cited

U.S. PATENT DOCUMENTS

| | | | |
|---|---|---|---|
| 2,872,193 | 2/1959 | Hamilton | 273/129 V |
| 3,642,284 | 2/1972 | Kordek | 273/127 R |
| 4,097,047 | 6/1978 | Ochi | 273/129 V |
| 4,229,876 | 2/1984 | Halliburton | 273/129 S |
| 4,398,718 | 8/1984 | Wiczer | 273/129 V |
| 4,487,416 | 12/1984 | Peters | 273/129 S |
| 4,508,343 | 4/1985 | Peters et al. | 273/127 R |
| 4,531,736 | 7/1985 | Sahler | 273/127 R |
| 4,804,186 | 2/1989 | Moravec | 273/127 R |
| 4,822,046 | 4/1989 | Kim et al. | 273/127 R |

*Primary Examiner*—T. Brown

*Attorney, Agent, or Firm*—Rockey and Rifkin

[57] ABSTRACT

The invention relates to a play feature for a pinball game able to assume a plurality of scoring positions. Various embodiments are disclosed, including two-position targets and four-position targets. The devices are actuated by a solenoid which cooperates with a cam to provide linear or rotary output to change the target position. The solenoids are actuated by a switch associated with the targets. The positions of the targets are sensed to provide different scoring values for each of the different positions.

5 Claims, 3 Drawing Sheets

TWO AND FOUR POSITION TARGET ASSEMBLY

This is a divisional of co-pending application Ser. No. 018,480 filed on 2/25/87, filed 2/25/87 now U.S. Pat. No. 4,822,046.

BACKGROUND OF THE INVENTION

This invention relates generally to pinball games and, more particularly, to a play feature for a pinball game.

Pinball games, as is well known, consist, generally, of a slanted playfield and a plurality of play features arranged on the playfield. A player uses flippers to direct a pinball at desired targets thereby scoring points.

The players of pinball machines are selective as to the machines they choose to play and base their selections on the various types of play feature schemes offered. Therefore, the popularity of a manufacturer's line of pinball games resides in its ability to appeal to the players by offering new and different play features.

OBJECTS AND SUMMARY OF THE INVENTION

It is a general object of the invention to provide a new and improved pinball machine play feature able to assume a plurality of scoring positions.

Another object is to provide a play feature which is economical to manufacture in terms of both the cost of the component parts, and the ease of assembly.

Another object is to provide a play feature which is durable enough to withstand the repetitive cycles of play over a sustained period of time.

Other objects of the invention, in addition to those set forth above, will become apparent to those skilled in the art from the following description.

The invention, in summary, consists of a target assembly which is able to be positioned to a plurality of orientations such that variable scoring opportunities are presented to the player. Three embodiments are contemplated, the first two being two-position targets and the third being a four-position target.

BRIEF DESCRIPTION OF THE DRAWINGS

The invention itself is set forth in the claims appended hereto and forming a part of the specifications while understandings of the embodiments thereof may be had by reference to the detailed description and the accompanying drawings in which:

DETAILED DESCRIPTION OF THE PREFERRED EMBODIMENTS

Figure 1:
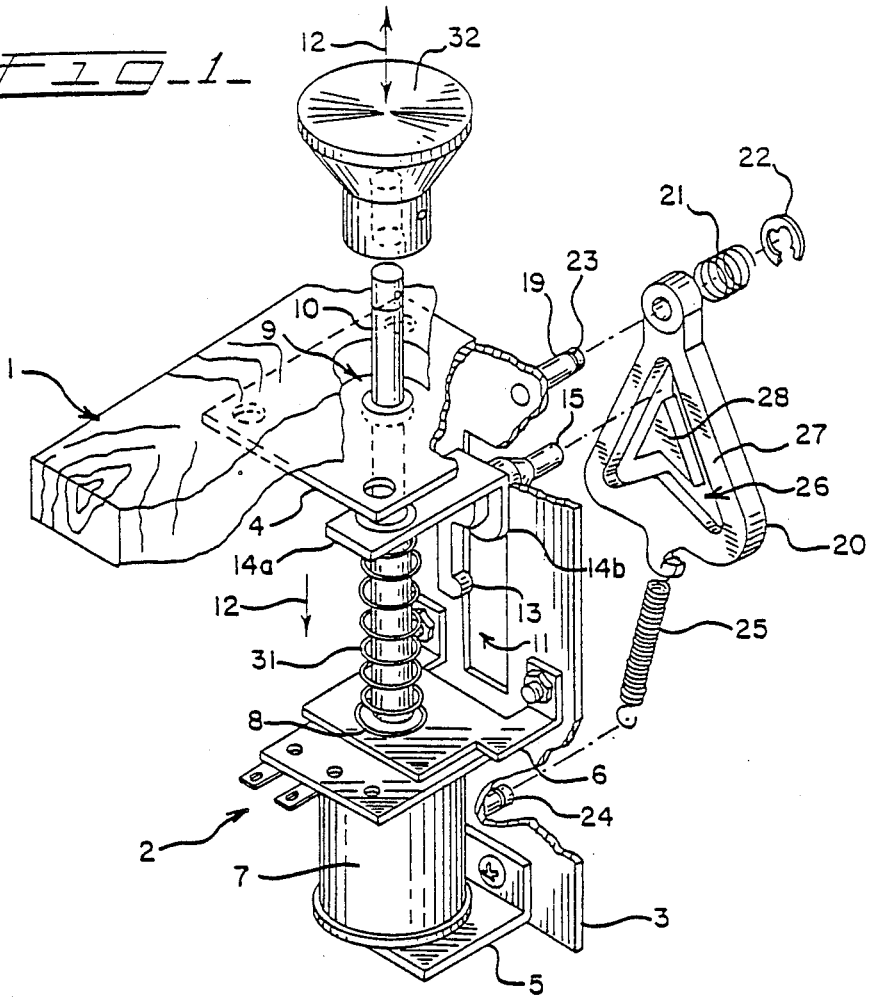
FIG. 1 shows a partially cut away perspective view of one embodiment of the play feature.

Referring more particularly to the drawings, FIG. 1 shows a first embodiment of the multipositional target. The target of FIG. 1 is able to assume two different play positions on the top surface of the playfield 1, of a pinball machine, a portion of which is shown. Attached to the bottom surface of that playfield 1 is the positioning mechanism 2 of the instant invention.

The positioning mechanism 2 includes a mainframe 3 attached to the bottom surface of the playfield 1 by a flange 4. Attached to a front face of the mainframe 3 are mounting brackets 5 and 6 supporting a solenoid 7 therebetween. Connected to the solenoid 7 and supported in bearings 8 and 9 is plunger-shaft 10. The plunger-shaft 10 extends through an aperture in the playfield and carries a target assembly 32 engageable by a ball during play of the game. Through this arrangement, energization of solenoid 7 results in a linear movement of the plunger-shaft 10 and target assembly 32, perpendicular to the playfield 1, in the direction of arrow 12.

Centrally disposed in the mainframe 3 is a rectangular opening 11 having a longitudinal axis parallel to the plunger-shaft 10 and perpendicular to the playfield. Rigidly attached to the plunger-shaft 10 is a slide member consisting of a plate having a first portion 14*a* attached to the plunger shaft 10 and a second portion 14*b* extending perpendicular to the first portion 14*a* and the playfield 1. The length of the slide member portion 14*a* is substantially equal to the distance between the plunger-shaft 10 and the opening 11 so that portion 14*b* is slidably received in opening 11. Mounted on slide member portion 14*b* is a camming pin 15 extending through a bore in slide portion 14*b*. The camming pin may be secured to the portion 14*b* by any suitable means. Coaxially located over plunger-shaft 10 and arranged between the slide member first portion 14*a* and the bracket 6 is a compression spring 31. The compression spring 31 serves to restore the plunger shaft 10 to its extended position when the solenoid 7 is deenergized.

Located on the back face of the mainframe 3, along the longitudinal axis of aperture 11, is a shaft 19 fixed to the mainframe 3. A cam guide 20 is mounted on the shaft 19 such that it is free to rotate relative to shaft 19. The cam guide 20 is urged towards the mainframe 3 by the compression spring 21 located on shaft 19 between the cam guide 20 and the spring clip 22, engaged in slot 23.

A pin 24 is fixed to and extends outwardly from the back face of the mainframe 3. The pin 24 is located on the opposite end of the mainframe 3 from the shaft 19 and is laterally offset from the longitudinal axis of the opening 11. A bias spring 25 is attached, at its one end, to the cam guide 20, and at its other end to pin 24. Since the pin 25 is offset from the longitudinal axis on which shaft 19 lies, the spring 25 provides a force biasing the cam guide in one direction.

The cam guide 20 is provided with a cam track 26 into which the camming pin 15 extends in which it may slide. The cam track 26, as shown in FIGS. 2A–2D, has, generally, a triangular shape formed by the outer edge of the track 27 and a generally triangular inner raised portion 28. The base of the raised portion is indented such that it rises to a peak to form a recess 29 at its lower midpoint.

As the cam track 26 is traversed by the camming pin 15 from point A to point B, in the direction of arrow C, it gradually becomes shallower. Thus, a wall or ledge 30 is formed where the deepest portion A meets the shallowest portion B. Therefore, the path of travel of the camming pin, in moving from point A to point B, is spiral-like. The function of this element will be hereinafter described.

Located on the mainframe 3 is a microswitch 13 (FIG. 1). The microswitch being an on/off switch operates as a binary system having one signal for the extended position of the plunger-shaft 10 and a second signal for the retracted position of the plunger-shaft. The microswitch 13 is mounted so that its actuating lever extends into the vicinity of aperture 11 to be contacted by the slide member second portion **14*b* when the plunger-shaft 10 is retracted. I should be noted that the length of the second portion 14*b* is such that the microswitch lever will remain depressed as the camming pin 15 moves from the position of FIG. 2B through the position of FIG. 2D**.

OPERATION OF THE FIRST EMBODIMENT:

With the solenoid 7 deenergized the plunger-shaft 10 is in its extended position, as shown in FIG. 1. The guide cam 23 is in the position of FIG. 2A, the target 32 is in its first, upper position and the microswitch 13 is not depressed.

The solenoid 7 is energized when, according to a game concept, the change of the target's position is required. The energization of the solenoid results in retracting movement of the plunger-shaft 10 and that results in movement of the camming pin 15 within the cam track 26. The movement of the camming pin 15 within the cam track 26, provided with a sloping surface rising from point A to point B, and the corresponding pivotal movement of the cam guide 20 is shown in FIGS. 2A–2D.

Figure 2A:
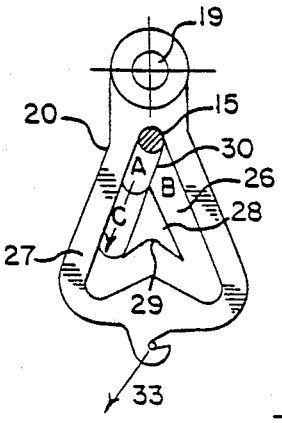
FIGS. 2A–2D show one cycle of the operation of the camming device of the first and second embodiments of the invention.
Figure 2B:
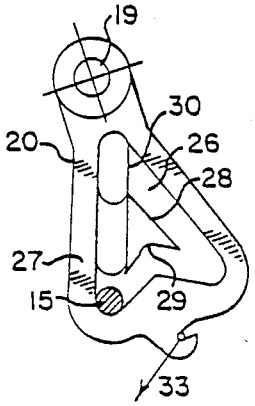
Figure 2C:
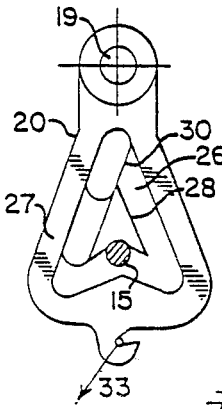

The initial movement of the camming pin 15, caused by the initial energization of solenoid 8, in cam track 26 is shown in FIGS. 2A and 2B. The camming pin 15 rides in the cam track 26 resulting in pivoting movement of the cam guide 20, towards the right as viewed in FIGS. 2A and 2B. Ledge 30 in the cam track 26, abuts the camming pin 15 and insures that the camming pin 15 moves along the path designated by arrow C. As the cam track decreases in depth, it is necessary for the cam guide 20 to slide on the shaft 19 away from the mainframe 3, to compensate for the decreasing depth of the cam track 26. This is accomplished by the spring 21 biasing the cam guide 20 toward the mainframe 3 while insuring that the cam guide and a camming pin 15 remain in contact regardless of the variations in depth of the cam rack 26. When the camming pin 15 reaches the position shown in FIG. 2B, the solenoid 8 is deenergized and spring 31 will attempt to restore the plunger-shaft 10 to its extended position. However, when this happens, the bias spring 25, because of its connection to offset pin 24, will provide a force, in the direction of arrow 33, which will tend to pull the guide cam 20 to the left, as viewed in FIG. 2B. Therefore, upward movement of the camming pin 15 is limited to a slight upward movement along the bottom of the cam rack 26 until it engages the recess 29 in the raised portion 28 Consequently, the plunger-shaft 10 and target 32 are locked in a second or lowered position. The microswitch 13 will remain closed to indicate in the game scoring circuitry that the target is in the lowered position. The slide member portion **14*b* is dimensioned to insure that the microswitch will remain depressed as the camming pin moves from the position of FIG. 2B to that of FIG. 2C**. By this means the need to continually energize the solenoid is eliminated as is the need for additional circuitry.

Figure 2D:
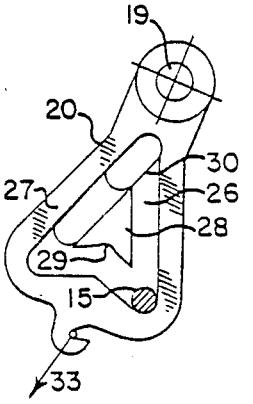

According to the concept of the game, when the first or raised target position is again desired, the solenoid 7 will be energized to again retract the plunger-shaft 10. The camming pin 15 will then move downward slightly and will be pulled out of the notch 29 permitting the bias spring 25 to pull the cam guide 20 further to the left as shown in FIG. 2D. The compression spring 31 will return the plunger-shaft, camming pin 15, and target 32 to the extended locked position shown in FIG. 2A and FIG. 1. As the camming pin 15 moves from point B to point A, from the position of FIG. 2D to that of FIG. 2A, it will be "snapped" into the reset position by spring 21 as it passes over the wall or ledge 30. In the extended locked position of FIGS. 1 and 2A, the slide member portion **14*b* will no longer contact the microswitch 13**, thus indicating the first position.

The second embodiment will now be described with particular reference to FIGS. 3 through 8. The target positioner of this embodiment is shown generally at 101 in FIG. 3, and is attached to the bottom of a playfield 102 by the bracket 103. Connected to the bracket 103 and extending perpendicularly to the playfield 102 is a mainframe 104. An actuator mounting bracket 105, supporting a solenoid 106, is connected to one side of the mainframe 104.

Figure 4:
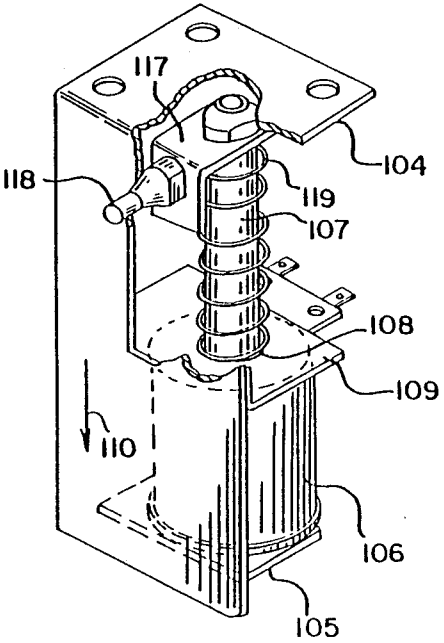
FIG. 4 shows a perspective view of the actuating member of the second embodiment.

As shown in FIG. 4 the solenoid 106 includes a plunger-shaft 107, supported in a bearing 108 of mounting bracket 109. Energization of the solenoid 106 results in linear movement of the plunger-shaft 107 in the direction of arrow 110.

Centrally located in the mainframe 104 is rectangular vertically extending slot 116 whose longitudinal axis extends perpendicular to the playfield. The slot 116 is aligned with and extends parallel to the plunger-shaft 107 for substantially the same length as the plunger-shaft. Fixed to the free end of the plunger-shaft 107 is slide member 117 carrying a camming pin 118. Slide member 117 can be affixed by any convenient arrangement such as the nut and screwthread arrangement shown in FIG. 4. The camming pin 118 extends perpendicularly to the plunger-shaft 107 through the slot 116. Located between the slide member 117 and the mounting bracket 109, and arranged concentrically with the plunger-shaft 107, is a spring 119. Spring 119 serves to return the plunger-shaft 46 to its extended position upon deenergization of the solenoid 106.

Located on the opposite side of the mainframe 104 from the solenoid actuator 106 is a barrel cam assembly 120. Supported on the mainframe 104 and extending perpendicularly thereto is a barrel cam support bracket 128 rotatably supporting the barrel cam assembly shown in FIG. 5. The barrel cam assembly consists of barrel cam 122 and a shaft 123 secured through the longitudinal axis of the barrel cam. The shaft 123 passes through the bracket 103 and through an opening in the playfield and extends a distance therebeyond.

Figure 6:
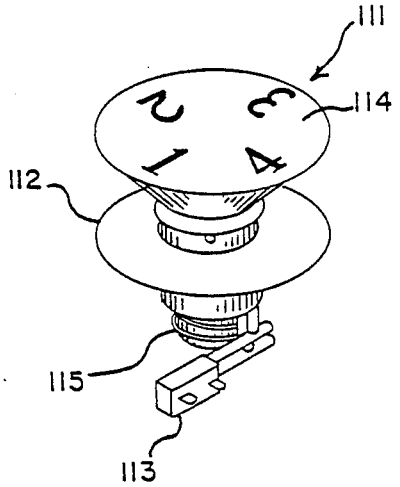
FIG. 6 shows a perspective view of the target assembly used in the second embodiment.

A target assembly 111, of the type shown in FIG. 6, is fixed to the shaft 123 above the playfield. The target assembly 111 consists of a switch actuator 112, a sensing leaf switch 113, an indexing target and top 114, and a resetting coil spring 115.

The barrel cam 122 is mounted with the camming pin 118 extending into a cam track 124. Due to the shape of the cam track the linear motion of the plunger-shaft 107 results in rotary motion of the barrel cam 122. The cam track 124 has a repeating pattern where each pattern traverses 90° of the circumference of the barrel cam 122. Each repeating pattern consists of a sloping segment 125 and a substantially vertical segment 126.

During the retracting movement of the plunger-shaft 107, the camming pin 118 will travel downward through a sloping segment 125. During the return movement of the plunger-shaft 107 the camming pin will travel upward through the substantially vertical segment 126. Therefore, one cycle of movement of the plunger-shaft 107 moves the camming pin 118 through one of the repeating patterns of the cam track 124 resulting in a 90° rotation of the barrel cam. Four cycles of movement of the plunger-shaft will, therefore, rotate the barrel cam 360°.

Figure 3:
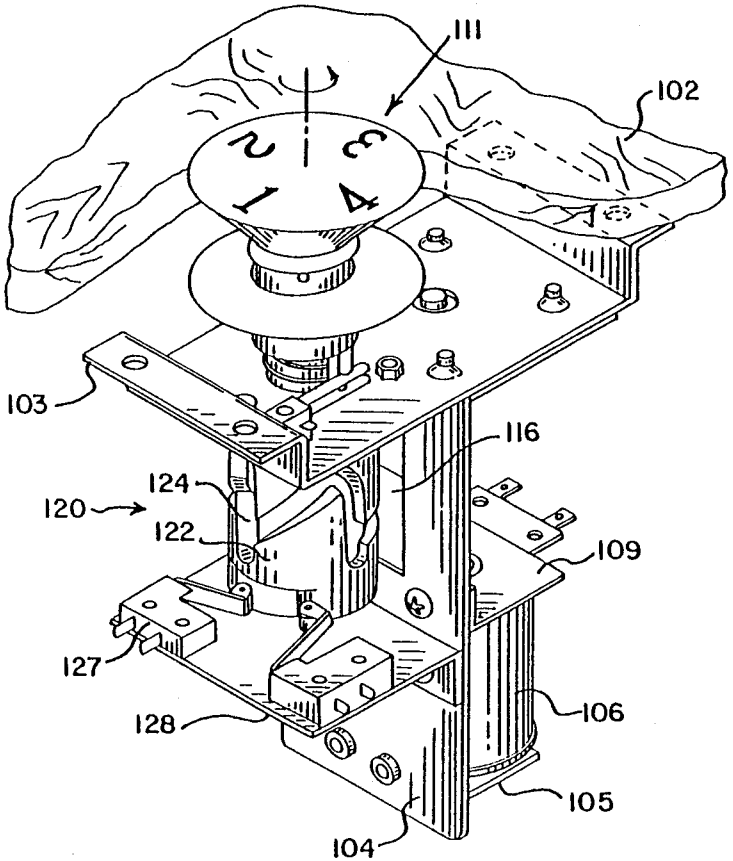
FIG. 3 shows a partially cut away perspective view of a second embodiment of the play feature.
Figure 5:
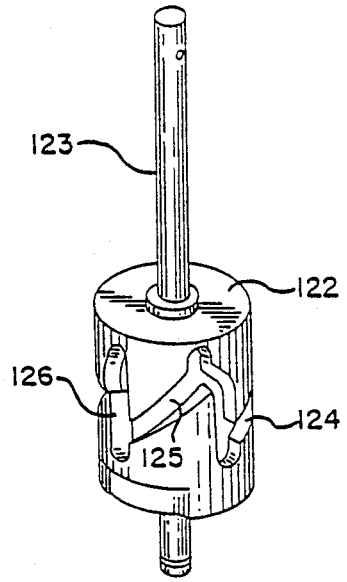
FIG. 5 shows a perspective view of the barrel cam sub-assembly of the second embodiment.

Microswitches 127 and 128 are provided to sense the orientation of the cam barrel and to indicate different scores for each orientation. As shown in FIG. 3, the actuating levers of microswitches 57 and 58 contact the base of the barrel cam 12. Both microswitches contact the barrel within the same quadrant.

Figure 7:
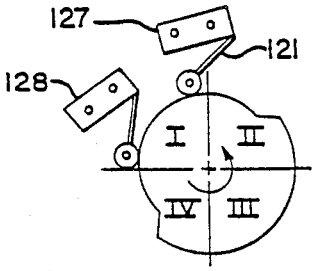
FIG. 7 shows a sectional view of the cam shown in FIG. 5.

FIG. 7 shows a cross-section of the barrel, through the area where the barrel is contacted by the microswitches. The barrel is divided into quadrants I, II, III, and IV. The two microswitches 127 and 128 contact the barrel in the same quadrant. In quadrant I both microswitches are open, in quadrant II microswitch 127 is closed and microswitch 128 is open, in quadrant III both microswitches are closed, and in quadrant IV microswitch 128 is closed and microswitch 127 is open. Thus, the two microswitches are able to indicate each of the four positions. The signals from the microswitches can be combined in appropriate logic circuitry to provide different scoring values depending upon the position of the barrel cam.

OPERATION OF THE SECOND EMBODIMENT:

In one mode of operation when a ball hits the target, the solenoid may be activated at the same time a score is registered. The ball striking the switch actuator 112 which is moved downward, to contact the leaf switch 113.

When the solenoid 106 is actuated, the plunger-shaft 107 causes the camming pin 118 to also move downward in cam track 124. The camming pin 118 moves from its uppermost position to its lowermost position through the spiral segment 125 of the cam track 124. Because of the slope of the spiral segment 125, the downward movement of the camming pin 118 results in rotating motion of the barrel cam 122 and its associated target 111.

The solenoid, when it reaches its retracted position, is deenergized. The spring 119 returns the actuating pin 51 to its uppermost position. During this portion of travel the actuating pin moves in the substantially vertical cam track segment 126. At this time the barrel cam and target have been rotated through 90°. The barrel cam, in its rotation, has changed the state of the microswitches such that the new score will be registered.

In this manner, every time a pinball hits the switch actuator, the barrel cam and target are rotated 90°. Each 90° of rotation gives a different signal due to the activation of the pair of microswitches to each on of the four different position combinations.

Figure 8:
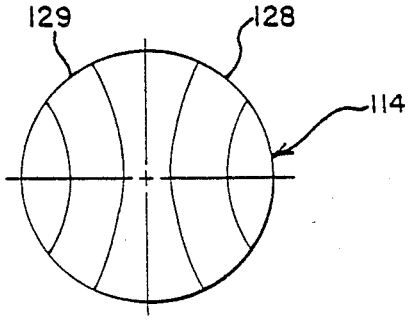
FIG. 8 shows a top view of a specific target assembly used in the second embodiment.

FIG. 8 shows a top view of another embodiment for the design of the target top 114'. Located in the target top 114 are basically curved grooves 128 and 129. The grooves are dimensioned such that a ball is able to pass through the grooves. The device, therefore, changes the ball's direction as the ball is detoured through the curved grooves. As the target is rotated, different pathways will be presented such that four different possible orientations ar presented to the player.

It should be understood that changes, variations, and modifications may be effected in the details and operations of the present invention, without departing from the spirit and scope thereof, as defined in the appended claims.

What is claimed is:

1. In a flipper-type pinball game machine of the type having an inclined playfield having an opening therein and which supports a rolling ball and one or more play features, the improved play feature comprising:

(a) ball target means extending through said opening to be contacted by a ball rolling on said playfield;

(b) means for rotating said ball target to a plurality of predetermined positions, said positioning means include: i linear actuating means and ii cam means engaging said linear actuating means to control movement of said ball target means to said predetermined positions.

2. The playfield feature of claim 1 further including sensing means for sensing the position of said for means for rotating and for registering a score based on the position.

3. The playfield feature of claim 1 wherein said linear actuating means includes a solenoid having a plunger-shaft and a cam pin carried thereon;

said cam means including a rotatable shaft to which said ball target is mounted and having a cam track thereon, said cam pin extending into said cam track;

whereby operation of said solenoid causes movement of said cam pin in said cam track to rotate said rotatable shaft and said target mounted thereon.

4. The play feature of claim 1, wherein said linear actuator means comprises a solenoid having a plunger-shaft carrying a cam pin; said cam means include a rotatably supported barrel cam having a cam track an output shaft extending above the playfield and connected to said ball target means, said cam pin extends into said cam track of said barrel cam whereby operation of said solenoid causes movement of said cam pin in said cam track to rotate said output shaft and said target connected thereto.

5. The play feature of claim 4 wherein said cam track includes locking positions and said cam pin can be locked in one of at least two positions along said cam track.

* * * * *